US006597281B1

(12) United States Patent
Thomas

(10) Patent No.: US 6,597,281 B1
(45) Date of Patent: Jul. 22, 2003

(54) PAGER BELT BUCKLE DEVICE

(76) Inventor: Gerald L. Thomas, 6026 N. Winthrop Ave. 6-H, Chicago, IL (US) 60660

( * ) Notice: Subject to any disclaimer, the term of this patent is extended or adjusted under 35 U.S.C. 154(b) by 455 days.

(21) Appl. No.: 09/675,177

(22) Filed: Sep. 29, 2000

(51) Int. Cl.[7] ..... G08C 19/00
(52) U.S. Cl. ..... 340/7.63; 340/539; 24/163 R
(58) Field of Search ..... 340/7.63, 539; 24/163 R

(56) References Cited

U.S. PATENT DOCUMENTS

| | | | | |
|---|---|---|---|---|
| 4,300,129 A | | 11/1981 | Cataldo | |
| D270,682 S | | 9/1983 | Rudd | |
| 4,578,739 A | * | 3/1986 | McKee et al. | 361/395 |
| 4,753,377 A | | 6/1988 | Poluhowich | |
| 5,007,105 A | | 4/1991 | Kudoh et al. | |
| 5,297,118 A | | 3/1994 | Sakumoto | |
| 5,737,688 A | | 4/1998 | Sakai et al. | |

FOREIGN PATENT DOCUMENTS

GB 2 198 898 A * 6/1988

* cited by examiner

*Primary Examiner*—Michael Horabik
*Assistant Examiner*—M. Shimizo

(57) ABSTRACT

A pager belt buckle device for conveniently combining a belt buckle with a pager unit. The pager belt buckle device includes a belt buckle member having an upper elongate support portion and a lower elongate support portion being spaced apart and further having a housing portion integrally attached to the upper and lower elongate support portions and being disposed therebetween and being recessed along a longitudinal back side of the elongate support portions thus forming a belt receiving slot between the upper and lower elongate support portions; and also includes pin-like support members being removably connected to the upper and lower support portions and extending therebetween; and further includes a catch member hingedly mounted about a first of the pin-like support members; and further includes a pager assembly for receiving radio signals.

9 Claims, 2 Drawing Sheets

PAGER BELT BUCKLE DEVICE

BACKGROUND OF THE INVENTION

1. Field of the Invention

The present invention relates to a beeper belt buckle and more particularly pertains to a new pager belt buckle device for conveniently combining a belt buckle with a pager unit.

2. Description of the Prior Art

The use of a beeper belt buckle is known in the prior art. More specifically, a beeper belt buckle heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,300,129; U.S. Pat. No. 5,297,118; U.S. Pat. No. 5,737,688; U.S. Pat. No. 5,007,105; U.S. Pat. No. 4,753,377; and U.S. Pat. No. Des. 270,682.

While these devices fulfill their respective, particular objectives and requirements, the aforementioned patents do not disclose a new pager belt buckle device. The inventive device includes a belt buckle member having an upper elongate support portion and a lower elongate support portion being spaced apart and further having a housing portion integrally attached to the upper and lower elongate support portions and being disposed therebetween and being recessed along a longitudinal back side of the elongate support portions thus forming a belt receiving slot between the upper and lower elongate support portions; and also includes pin-like support members being removably connected to the upper and lower support portions and extending therebetween; and further includes a catch member hingedly mounted about a first of the pin-like support members; and further includes a pager assembly for receiving radio signals.

In these respects, the pager belt buckle device according to the present invention substantially departs from the conventional concepts and designs of the prior art, and in so doing provides an apparatus primarily developed for the purpose of conveniently combining a belt buckle with a pager unit.

SUMMARY OF THE INVENTION

In view of the foregoing disadvantages inherent in the known types of beeper belt buckle now present in the prior art, the present invention provides a new pager belt buckle device construction wherein the same can be utilized for conveniently combining a belt buckle with a pager unit.

The general purpose of the present invention, which will be described subsequently in greater detail, is to provide a new pager belt buckle device which has many of the advantages of the beeper belt buckle mentioned heretofore and many novel features that result in a new pager belt buckle device which is not anticipated, rendered obvious, suggested, or even implied by any of the prior art beeper belt buckle, either alone or in any combination thereof.

To attain this, the present invention generally comprises a belt buckle member having an upper elongate support portion and a lower elongate support portion being spaced apart and further having a housing portion integrally attached to the upper and lower elongate support portions and being disposed therebetween and being recessed along a longitudinal back side of the elongate support portions thus forming a belt receiving slot between the upper and lower elongate support portions; and also includes pin-like support members being removably connected to the upper and lower support portions and extending therebetween; and further includes a catch member hingedly mounted about a first of the pin-like support members; and further includes a pager assembly for receiving radio signals.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pager belt buckle device which has many of the advantages of the beeper belt buckle mentioned heretofore and many novel features that result in a new pager belt buckle device which is not anticipated, rendered obvious, suggested, or even implied by any of the prior art beeper belt buckle, either alone or in any combination thereof.

It is another object of the present invention to provide a new pager belt buckle device which may be easily and efficiently manufactured and marketed.

It is a further object of the present invention to provide a new pager belt buckle device which is of a durable and reliable construction.

An even further object of the present invention is to provide a new pager belt buckle device which is susceptible of a low cost of manufacture with regard to both materials and labor, and which accordingly is then susceptible of low prices of sale to the consuming public, thereby making such pager belt buckle device economically available to the buying public.

Still yet another object of the present invention is to provide a new pager belt buckle device which provides in the apparatuses and methods of the prior art some of the advantages thereof, while simultaneously overcoming some of the disadvantages normally associated therewith.

Still another object of the present invention is to provide a new pager belt buckle device for conveniently combining a belt buckle with a pager unit.

Yet another object of the present invention is to provide a new pager belt buckle device which includes a belt buckle member having an upper elongate support portion and a lower elongate support portion being spaced apart and further having a housing portion integrally attached to the upper and lower elongate support portions and being disposed therebetween and being recessed along a longitudinal back side of the elongate support portions thus forming a belt receiving slot between the upper and lower elongate support portions; and also includes pin-like support members being removably connected to the upper and lower support portions and extending therebetween; and further includes a catch member hingedly mounted about a first of the pin-like support members; and further includes a pager assembly for receiving radio signals.

Still yet another object of the present invention is to provide a new pager belt buckle device that safely secures one's pager upon one's person.

Even still another object of the present invention is to provide a new pager belt buckle device that eliminates the user from having to worry about losing or finding one's pager.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
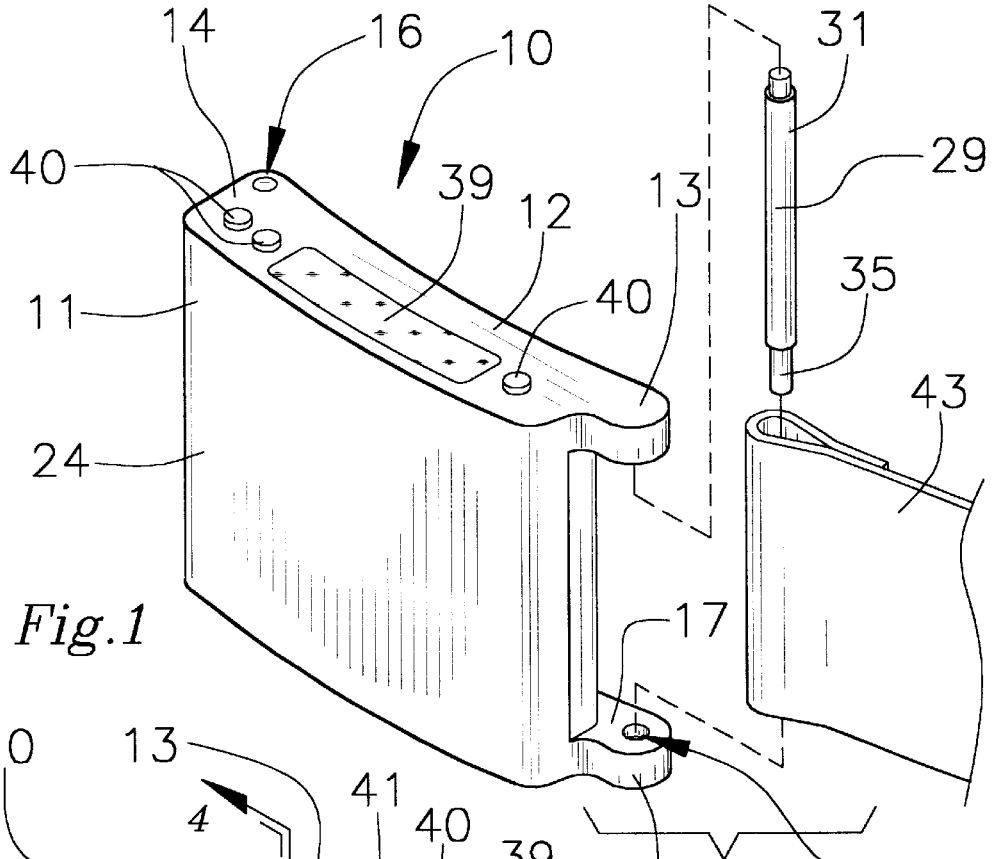
FIG. 1 is a front perspective view of a new pager belt buckle device according to the present invention.
Figure 2:
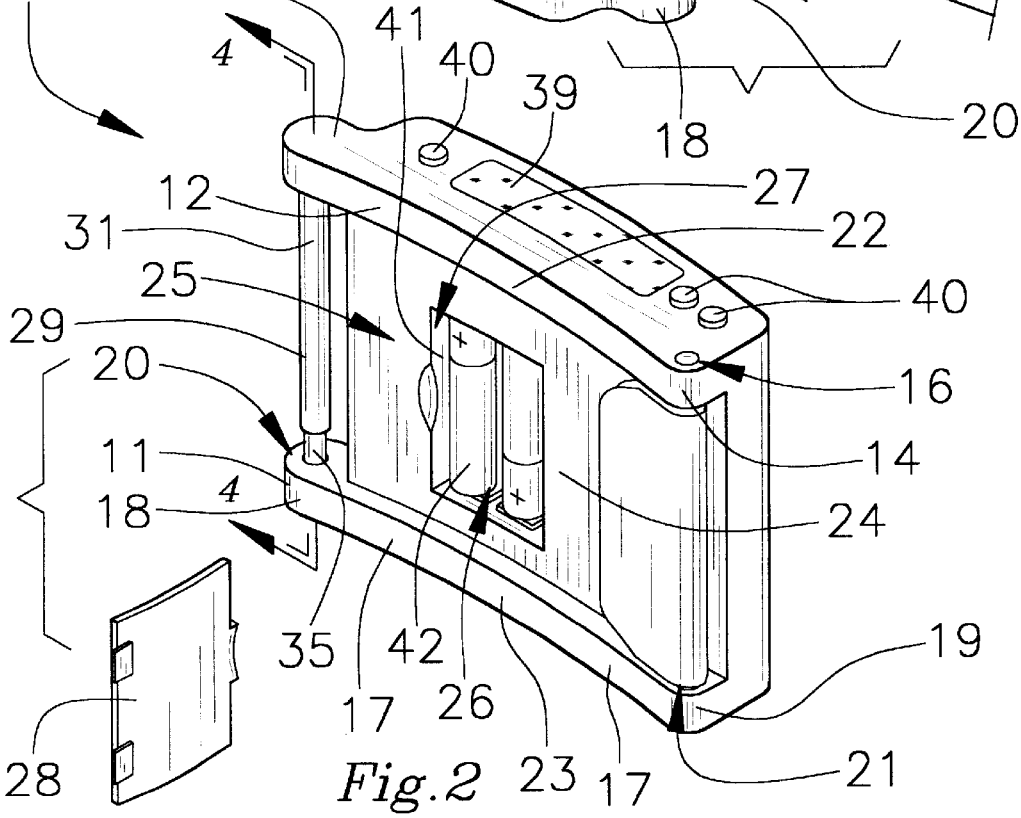
FIG. 2 is a rear perspective view of the present invention.
Figure 3:
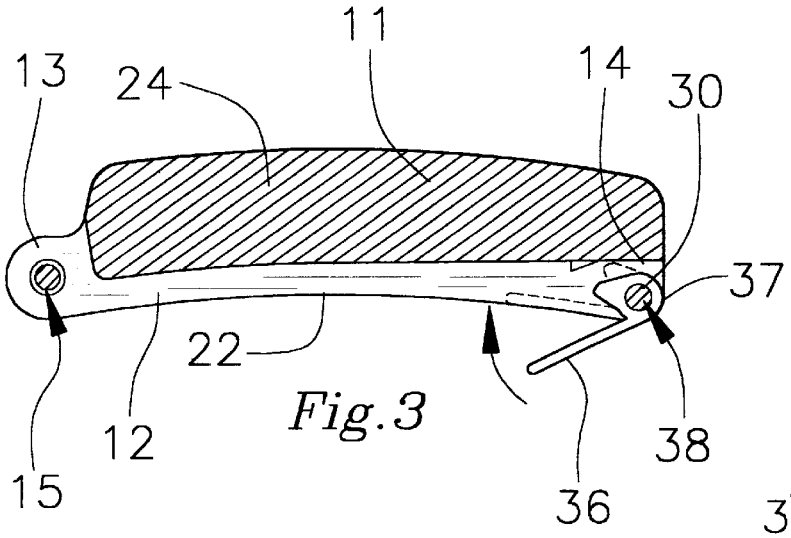
FIG. 3 is a top plan view of the present invention.
Figure 4:
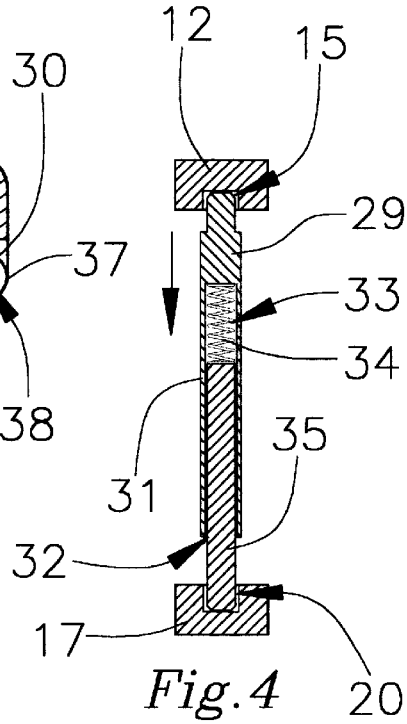
FIG. 4 is a cross-sectional view of the present invention.
Figure 5:
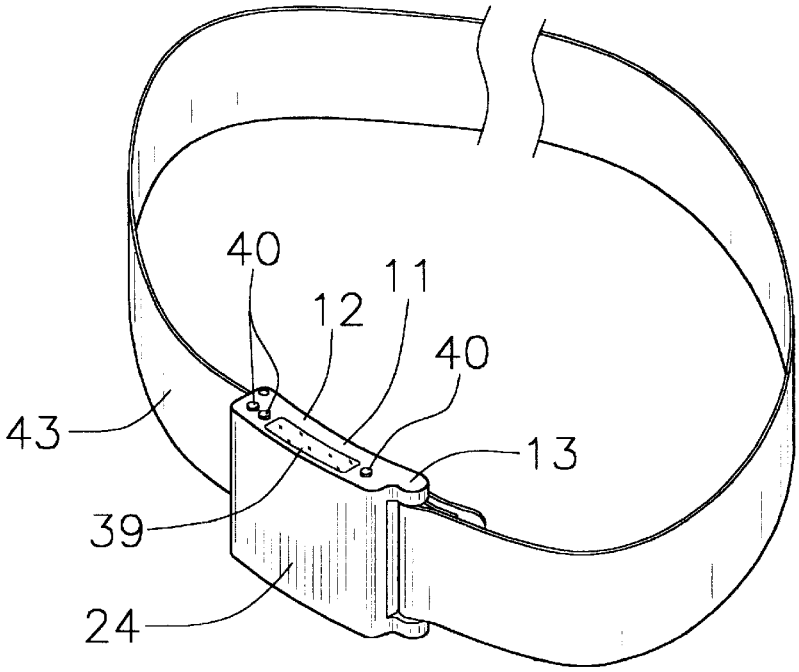
FIG. 5 is a perspective view of the present invention shown in use with a belt.

With reference now to the drawings, and in particular to FIGS. 1 through 5 thereof, a new pager belt buckle device embodying the principles and concepts of the present invention and generally designated by the reference numeral 10 will be described.

As best illustrated in FIGS. 1 through 5, the pager belt buckle device 10 generally comprises a belt buckle member 11 having an upper elongate support portion 12 and a lower elongate support portion 17 being spaced apart and further having a housing portion 24 integrally attached to the upper and lower elongate support portions 12,17 and being disposed therebetween and being recessed along longitudinal back sides 22,23 of the elongate support portions 11,17 thus forming a belt receiving slot between the upper and lower elongate support portions 11,17. The housing portion 24 includes a battery compartment 26 disposed therein, and also includes a battery compartment opening 27 disposed in a back wall 25 of the housing portion 24, and further includes a cover 28 removably disposed over the battery compartment opening 27. The longitudinal back sides 22,23 of the elongate support portions 11,17 are generally bowed inwardly with the housing portion 24 having a length substantially greater than its thickness.

Pin-like support members 29,30 are removably connected to the upper and lower support portions 11,17 and extend therebetween. Each of the pin-like support members 29,30 includes a tubular member 31 having an open end 32 and a bore 33 extending therein through the open end 32, and also includes a spring 34 being disposed in the bore 33 of the tubular member 31, and further includes a shaft 35 movably disposed in the bore 33 and being biasedly extended from the open end 32 of the tubular member 31. Each of the upper and lower elongate support portions 11 ,17 has a first end portion 13,18 which extends beyond the housing portion 24 with each of the first end portions 13,18 having a hole 15,20 disposed therein and being in alignment with one another and also being adapted to receive ends of a second pin-like support member 29. Each of the upper and lower elongate support portions 11,17 also has a second end portion 14,19 which has a hole 16,21 disposed therein and being in alignment with one another and also being adapted to receive ends of the first pin-like support member 30.

A catch member 36 is hingedly and conventionally mounted about a first of the pin-like support members 30 with the catch member 36 being essentially a lever having an end portion 37 and a bore 38 extending through the end portion 37. The bore 38 of the lever is adapted to receive the first pin-like support member 30 with the lever being adapted to pivotally and securely engage a portion of a belt 43 between itself and the back wall 25 of the housing portion 24.

A pager means for receiving radio signals includes a readout display screen 39 conventionally disposed in a top of the upper elongate support member 12, and also includes a plurality of depressible function-performing members 40 also being conventionally disposed in the top of the upper elongate support member 12, and further includes a signal receiving member 41 being securely disposed in the housing portion 24, and also includes batteries 42 being removably disposed in the battery compartment 26 for energizing the signal receiving member 41.

In use, the user would use the pager belt buckle device 10 just like any buckle for a conventional belt except that the present invention also includes a pager means disposed therein so that the user doesn't need to have both a pager and a buckle. The pager belt buckle device 10 would be used to fasten the ends of the belt 43 about the waist of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pager belt buckle device comprising:

a belt buckle member having an upper elongate support portion and a lower elongate support portion being spaced apart and further having a housing portion integrally attached to said upper and lower elongate support portions and being disposed therebetween and being recessed along a longitudinal back side of said elongate support portions thus forming a belt receiving slot between said upper and lower elongate support portions;

pin-like support members being removably connected to said upper and lower support portions and extending therebetween;

a catch member hingedly mounted about a first of said pin-like support members;

a pager means for receiving radio signals; and wherein each of said upper and lower elongate support portions has a first end portion which extends beyond said housing portion each of said first end portions having a hole disposed therein and being in alignment with one another and also being adapted to receive ends of a second of said pin-like support members.

2. A pager belt buckle device as described in claim 1, wherein each of said upper and lower elongate support portions also has a second end portion which has a hole disposed therein and being in alignment with one another and also being adapted to receive ends of said first pin-like support member.

3. A pager belt buckle device as described in claim 2, wherein each of said pin-like support members includes a tubular member having an open end and a bore extending therein through said open end, and also includes a spring being disposed in said bore of said tubular member, and further includes a shaft movably disposed in said bore and being biasedly extended from said open end of said tubular member.

4. A pager belt buckle device as described in claim 3, wherein said housing portion includes a battery compartment disposed therein, a battery compartment opening disposed in a back wall of said housing portion, and a cover removably disposed over said battery compartment opening.

5. A pager belt buckle device as described in claim 4, wherein said catch member is essentially a lever having an end portion and a bore extending through said end portion, said bore of said lever being adapted to receive said first pin-like support member, said lever being adapted to pivotally and securely engage a portion of a belt between itself and said back wall of said housing portion.

6. A pager belt buckle device as described in claim 5, wherein said pager means includes a readout display screen disposed in a top of said upper elongate support member, a plurality of depressible function-performing members also being disposed in said top of said upper elongate support member, a signal receiving member being securely disposed in said housing portion, and batteries being removably disposed in said battery compartment for energizing said signal receiving member.

7. A pager belt buckle device as described in claim 6, wherein said longitudinal back sides of said elongate support portions are generally bowed inwardly.

8. A pager belt buckle device as described in claim 7, wherein said housing portion has a length substantially greater than its thickness.

9. A pager belt buckle device comprising:

a belt buckle member having an upper elongate support portion and a lower elongate support portion being spaced apart and further having a housing portion integrally attached to said upper and lower elongate support portions and being disposed therebetween and being recessed along a longitudinal back side of said elongate support portions thus forming a belt receiving slot between said upper and lower elongate support portions, each of said upper and lower elongate support portions having a first end portion which extends beyond said housing portion, said housing portion including a battery compartment disposed therein, a battery compartment opening disposed in a back wall of said housing portion, and a cover removably disposed over said battery compartment opening, said longitudinal back sides of said elongate support portions being generally bowed inwardly, said housing portion having a length substantially greater than its thickness;

pin-like support members being removably connected to said upper and lower support portions and extending therebetween, each of said pin-like support members including a tubular member having an open end and a bore extending therein through said open end, and also including a spring being disposed in said bore of said tubular member, and further including a shaft movably disposed in said bore and being biasedly extended from said open end of said tubular member, each of said first end portions having a hole disposed therein and being in alignment with one another and also being adapted to receive ends of a second of said pin-like support members, each of said upper and lower elongate support portions also having a second end portion which has a hole disposed therein and being in alignment with one another and also being adapted to receive ends of said first pin-like support member;

a catch member hingedly mounted about a first of said pin-like support members said catch member being essentially a lever having an end portion and a bore extending through said end portion, said bore of said lever being adapted to receive said first pin-like support member, said lever being adapted to pivotally and securely engage a portion of a belt between itself and said back wall of said housing portion; and a pager means for receiving radio signals including a readout display screen disposed in a top of said upper elongate support member, a plurality of depressible function-performing members also being disposed in said top of said upper elongate support member, a signal receiving member being securely disposed in said housing portion, and batteries being removably disposed in said battery compartment for energizing said signal receiving member.

* * * * *